US006975828B2

(12) United States Patent
Bessho et al.

(10) Patent No.: US 6,975,828 B2
(45) Date of Patent: Dec. 13, 2005

(54) IMAGE FORMING APPARATUS

(75) Inventors: Yuji Bessho, Chiba (JP); Koji Masuda, Ibaraki (JP); Yusuke Ishida, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 10/795,271

(22) Filed: Mar. 9, 2004

(65) Prior Publication Data

US 2004/0234302 A1 Nov. 25, 2004

(30) Foreign Application Priority Data

Mar. 12, 2003 (JP) ..... 2003-065978

(51) Int. Cl.[7] ..... G03G 15/36

(52) U.S. Cl. ..... 399/301; 399/6; 399/194; 358/45

(58) Field of Search ..... 399/6, 194, 301, 399/227, 223, 265, 267, 279; 358/450, 1.2

(56) References Cited

U.S. PATENT DOCUMENTS 4,912,491 A * 3/1990 Hoshino et al. ..... 347/116
5,223,939 A * 6/1993 Imaizumi et al. ..... 358/296
5,518,329 A * 5/1996 Beaudry ..... 400/621
5,537,518 A * 7/1996 Hasegawa ..... 358/1.18
5,631,747 A * 5/1997 Farrell et al. ..... 358/448
6,047,149 A * 4/2000 Nishimura et al. ..... 399/98
6,094,551 A * 7/2000 Nakamura et al. ..... 399/160
6,591,076 B2 * 7/2003 Connors ..... 399/194
6,650,864 B2 * 11/2003 Kikuchi et al. ..... 399/384

* cited by examiner

*Primary Examiner*—Christopher W. Fulton
*Assistant Examiner*—Amy R. Cohen
(74) *Attorney, Agent, or Firm*—Fitzpatrick, Cella, Harper & Scinto

(57) ABSTRACT

An image forming apparatus capable of preventing the increase of the size thereof by having a lengthened developer bearing member is provided with regard to an image forming apparatus capable of printing a registration mark (dragonfly) on a large sheet of recording paper for producing an art work in case of the use of a formed image as a printing manuscript. The length of the lengthwise direction of a developer bearing member provided in at least one developing device among the developing devices provided in the image forming apparatus is longer than those of the developer bearing members of the other developing devices.

7 Claims, 5 Drawing Sheets

IMAGE FORMING APPARATUS

BACKGROUND OF THE INVENTION

1. Field of the Invention

The present invention relates to an image forming apparatus using an electrophotographic process or an electrostatic recording process, and more particularly to an image forming apparatus such as a copying machine, a printer, a facsimile machine and a composite machine including a plurality of functions of the above-mentioned apparatus.

2. Description of Related Art

In an image forming apparatus for forming a color image by superposing a plurality of toner images each having different colors, for example as shown in FIG. 5, an image forming apparatus 70 using an intermediate transfer member 54 has been proposed conventionally with an object of obtaining a color image having no color shifts.

In the image forming apparatus 70, charging means 51, exposure means 52 and developing means 53 are disposed around an electrophotographic photosensitive member 50 as an image bearing member, and a developer image (toner image) is formed by performing a charging process, an exposure process and a developing process of each color sequentially on the basis of image information analyzed to each color. Then, the formed developer images are superposed on the intermediate transfer member 54, and a color image is formed on a recording material P such as paper, which is conveyed with conveyance rollers 55.

Hereupon, the developing means 53 for performing the developing process is composed of a rotation developing apparatus 53*a* and a fixed developing apparatus 53*b*. The rotation developing apparatus 53*a* adopts a rotation switching system and is mounted with a yellow developing device 53Y, a magenta developing device 53M and a cyan developing device 53C, which contain three kinds of color toners of yellow, magenta and cyan, respectively, as developers. The fixed developing apparatus 53*b* includes a black developing device 53B adopting a fixed system and containing a black toner as a developer.

The respective developing devices 53Y, 53M, 53C and 53B includes developing containers 532*y*, 532*m*, 532*c* and 532*k* for containing developers, developer bearing members 531*y*, 531*m*, 531*c* and 531*k* for conveying developers from the respective developing containers 532*y*–532*k* to the electrophotographic photosensitive member 50, and developer layer thickness regulating members (not shown) for regulating the quantities of the developers conveyed by the developer bearing members 531*y*–531*k*. Developing sleeves each formed to be a cylindrical sleeve rotating with a developer put on its peripheral surface are generally used as the developer bearing members 531*y*–531*k*. Developing blades formed in blades severally opposed to the developer bearing surfaces of the developer sleeves 531*y*–531*k* with a predetermined distance between each of the blades and each of the developer bearing surfaces are generally used as the developer layer thickness regulating members (layer thickness regulating members).

The use of the rotation developing apparatus 53*a* adopting the rotation switching system removes the necessity of consideration of the shapes of the developing devices according to respective dispositions, which consideration is required in case of disposing the developing devices 53Y, 53M and 53C of respective colors as individual bodies around the electrophotographic photosensitive member 50. Moreover, the capability of the color toner developing devices 53Y, 53M and 53C to be rotated and switched brings about an advantage enabling the size reduction of the rotation developing apparatus 53*a*. Moreover, because the number of the devices disposed around the electrophotographic photosensitive member 50 can be decreased, the image forming apparatus 70 has an advantage that the fixed developing apparatus 53*b* can increase its capacity of a black toner, which is generally consumed much.

Generally, four kinds of developing methods can be adopted as a developing method of the above-mentioned developing means 53 in case of using a non-magnetic toner as a developer. One of the developing methods is a one-component noncontact developing method for performing development with a toner being noncontact with a photosensitive drum being an electrophotographic photosensitive member, which toner is conveyed to the photosensitive drum by the rotation of a developing sleeve after the toner has been coated on the developing sleeve with a blade or the like. Another developing method is a one-component contact developing method for performing development with the toner being contact with the photosensitive drum. A further method is a two-component noncontact developing method for performing development with a developer being noncontact with a photosensitive drum, which developer to be used is a two-component developer made of mixing a non-magnetic toner and a magnetic carrier and is conveyed to the photosensitive drum with being borne on a developing sleeve by a magnetic force. A still further developing method is a two-component contact developing method for performing development with the developer being contacted with the photosensitive drum.

Among the above-mentioned four developing method, the two-component contact developing method using the developer made of mixing the toner and the magnetic carrier, i.e. the two-component developer, for performing the development with the developer being contact with the photosensitive drum has a high resolution and can easily obtain a half tone. Consequently, the two-component contact developing method are frequently used for an image forming apparatus such as a full color copying machine, which is demanded to have a high image quality.

Conventionally known carriers can be used as the carrier constituting the two-component developer to be used for the two-component contact developing method. The usable carriers are, for example, a resin carrier formed by dispersing magnetite as a magnetic material in a resin and by dispersing carbon black into the resin for making the resin conductive and for adjusting the resistance thereof, a carrier made by performing of the oxidization-reduction processing of the surface of a simple substance of magnetite such as ferrite for adjusting the resistance thereof, a carrier made by coating the surface of a simple substance of magnetite such as ferrite with a resin for adjusting the resistance thereof, and the like. The manufacturing methods of these magnetic carriers are not especially limited.

Moreover, a one-component jumping developing method using a one-component magnetic toner as a developer for performing development in a noncontact state by applying an alternating electric field to the developer has been generalized already as one of the most superior developing methods. The one-component jumping developing method has great advantages to obviate the control of the mixture ratio between a toner and a carrier in a developer, which control is necessary for the two-component developing methods, the absence of the problem of the deterioration of the carrier, and the capability of obtaining stable images for a long period.

Moreover, because the color of the magnetic material to be compounded into the one-component magnetic toner is generally black in the one-component jumping developing method, the method can be applied to the case of forming a black image using a black toner very suitably.

Moreover, at the time of charging the magnetic toner in the one-component jumping developing method, for example, the abutting of an elastic blade as a layer thickness regulating member against a metal rigid body sleeve being a developer bearing member, or the abutting of a metal blade as a layer thickness regulating member against an elastic sleeve as a developer bearing member brings about a good toner frictional electrification property and a uniform toner thin layer. Consequently, it is known that a high quality image output can be obtained with a simple configuration.

However, the adoption of such a developing blade method using the layer regulating members such as the elastic blade and the metal blade easily causes the deterioration of the toner owing to the stress upon the passage of the developing blade and the generation of much frictional heat, and consequently prevents the compatibility of the high image quality property of a toner image formed by the developing method and the lengthening of the life as the developing means.

Accordingly, for making the best use of the above-mentioned merit of the one-component jumping developing method enabling the stable acquisition of images for a long period, a toner regulating method changing the conventional developing blade system to use a magnetic blade or the like in a noncontact state with a developing sleeve has been proposed.

However, it is difficult to apply the proposed toner regulating method to a case using color toners such as a magenta toner, a cyan toner and a yellow toner at present.

Consequently, the following developing method (jumping and brush developing method) is more suitable for the development of the color toners of magenta, cyan and yellow and the like. In the developing method, a two-component developer formed by mixing a non-magnetic toner and a carrier is used, and a magnetic brush of the developer thin layer is formed on a developing sleeve to contact the magnetic brush with a photosensitive drum, and then an alternating electric field is applied to the photosensitive drum to perform development.

Moreover, when a full color copying machine is also used as a black-and-white copying machine, the frequency of using a black developing apparatus is very high. Consequently, the use of a one-component jumping development method into a black station is especially advantageous.

Consequently, an image forming apparatus using two-component development using a non-magnetic toner for the development the color toners of magenta, cyan, yellow and the like and magnetic one-component jumping development for the development of a black toner is regarded as a preferable one.

Now, in recent years, the use of a sheet of recording paper printed with an image forming apparatus as a direct print manuscript has been begun to be performed as the quality of the printing of the image forming apparatus has become higher.

There is a process for producing a manuscript called as an art work (or a block copy) by applying a character or a figure which is wanted to be printed on a sheet of white thick paper as a material of the art work among the printing work processes performed in the above-mentioned printing method using the recording paper. Also in the case of printing an image printed with the image forming apparatus, a process of sticking a sheet of recording paper as a recording material on which an image is formed to an art work material having a size larger than that of the sheet of recording paper is provided.

FIG. 3 shows a general form of an art work 19. On the art work 19, marks for registration are put on the outside of a print region 18 to be an object of printing including an image forming region and an image non-forming region, namely an area to which a sheet of recording paper printed with an image forming apparatus is stuck, for the location of the art work 19 to a printing machine. Such marks for registration are called as registration marks (designated by reference marks M1), and also called as dragonflies (register marks) from their shapes. The marks M1 could also be referred to as "alignment marks."

For example, for printing a double-spread page of the fourth sizes in A series, a sheet of recording paper P having the third size of the A series is used. Characters or figures are edited on the recording paper P, and the recording paper P is stuck in the print region 18 of an art work (block copy) material 17 while the position of the recording paper P is adjusted to the registration marks M1 formed on the thick paper having the size larger than that of the sheet of the recording paper P as the art work material 17 in order that the recording paper P, on which characters and figures are formed, may fall in the print region 18. Thus, the art work 19 is produced.

That is, the recording paper P is stuck on the art work material 17 in order that the recording paper P may fall in the inside of the registration marks M1 formed at four corners and both the sides of the central part of the print region 18.

Hereupon, if it is possible to use a sheet of art work material recording paper 17*a* having the same size as that of the art work material 17, and to apply the printing, being an image formed by an image forming apparatus on the usual recording paper P to be stuck in the print region 18, within the third size of A series to the art work material recording paper 17*a*, and further to print the registration marks M1 on the recording paper 17*a* at the same positions as those on the art work material 17, then the recording paper 17*a* itself can be used as the art work 19, and the art work 19 can be directly produced with the image forming apparatus. In this case, it is unnecessary to stick the recording paper P on the art work material 17, and consequently, the processes for printing can be reduced.

However, the sheet of the art work material recording paper 17*a* to be used for the production of the art work 19 has a size larger than that of the sheet of the standard recording paper P against an image to be formed, and there are a case where the positions at which the registration marks M1 are printed are positions corresponding to margin portions of the standard recording paper P. Consequently, it is apprehended that the image forming apparatus becomes large in size.

SUMMARY OF THE INVENTION

It is an object of the present invention to provide an image forming apparatus capable of forming registration marks while preventing the increase of the size of the image forming apparatus.

It is another object of the present invention to provide an image forming apparatus including a plurality of image forming means for forming images having different colors from one another on a recording material, wherein the length of the lengthwise direction of a region, in which the images can be formed, of image forming means for forming a registration mark on the recording material is longer than those of the other imager forming means.

Further objects of the present invention will be apparent from the following detailed description with reference to the attached drawings.

DETAILED DESCRIPTION OF THE PREFERRED EMBODIMENTS

In the following, image forming apparatus according to the present invention will be described further in detail on the basis of the attached drawings.

[Embodiment 1]

Figure 1:
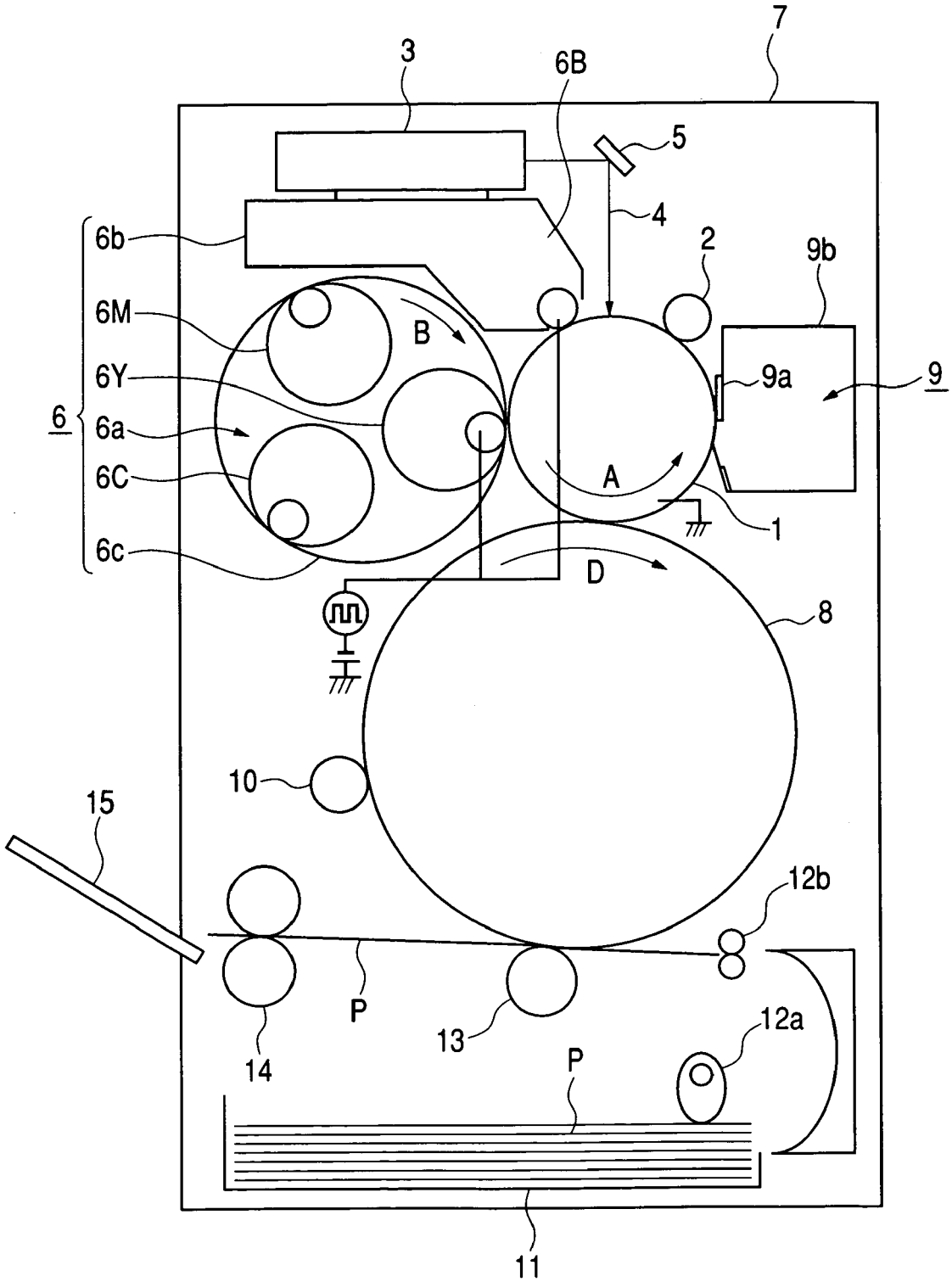
FIG. 1 is a schematic structural view showing an embodiment of an image forming apparatus according to the present invention.
Figure 2:
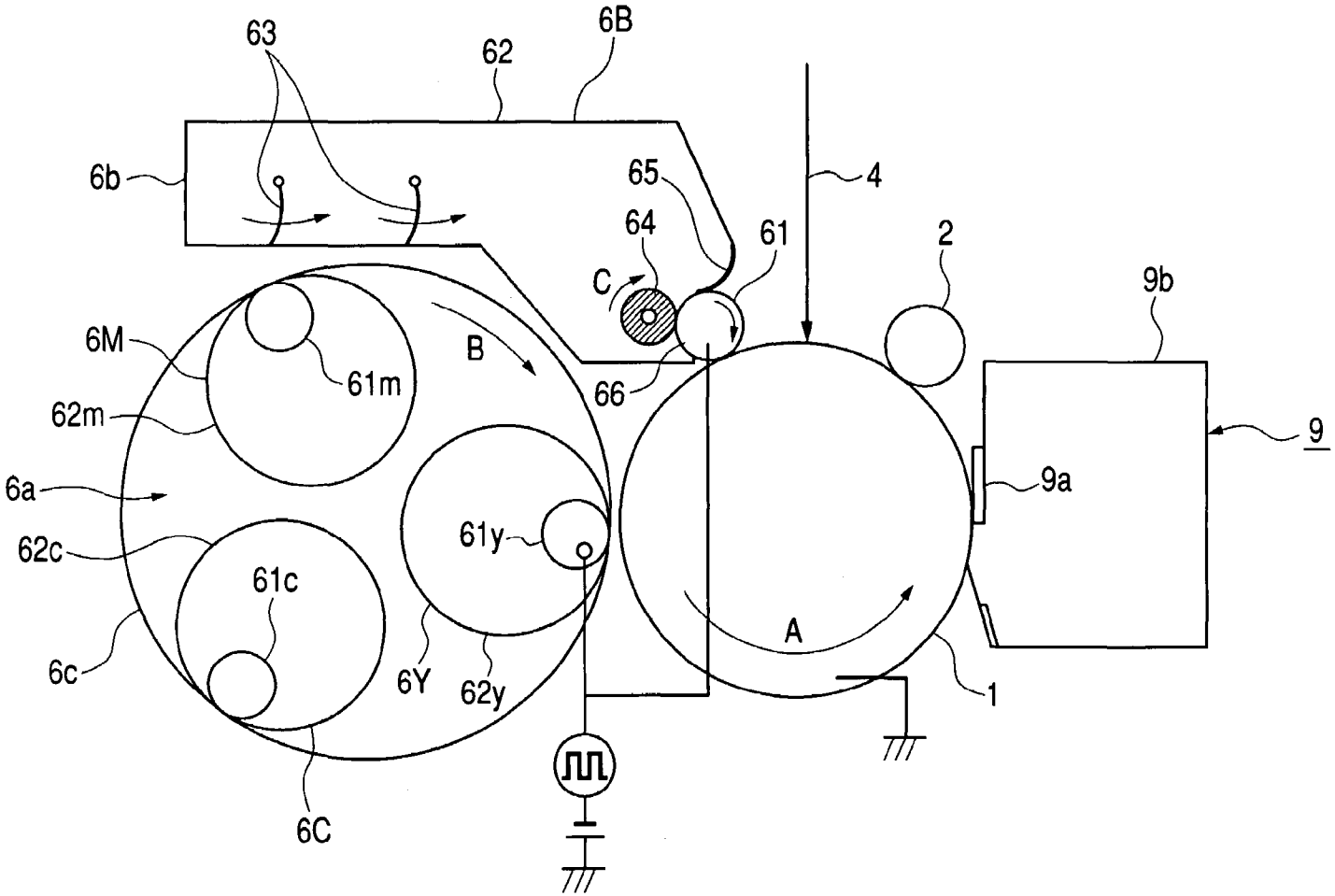
FIG. 2 is a schematic structural view showing an example of an image forming portion of the image forming apparatus according to the present invention.

FIGS. 1 and 2 will be referred to while an image forming apparatus 7 according to a first embodiment (Embodiment 1) of the present invention is described. Incidentally, FIG. 1 is a schematic structural view showing the whole of the image forming apparatus 7 of the present embodiment. FIG. 2 is a schematic cross sectional view showing an arrangement of an image bearing member, on the surface of which an image is formed, and image forming means disposed around the image bearing member.

In the present embodiment, the electrophotographic image forming apparatus 7 is used as an image forming apparatus. As shown in FIG. 1, as an image bearing member, a photosensitive drum 1 being an electrophotographic photosensitive member composed of a cylindrical base and a photoconductive layer formed thereon, which is made of an organic photoconductor, is attached rotatably at a predetermined circumferential speed in the direction of an arrow A. Incidentally, in the present embodiment, the photosensitive drum 1 is provided with the photoconductive layer made of an organic photoconductor material formed on an aluminum cylinder having an outer diameter of 50 mm, and a surface protection layer for improving the mold release characteristics of toners and preventing the shaving of the photoconductive layer.

The peripheral surface of the photosensitive drum 1 is charged to have a predetermined polarity and predetermined electric potential by a charging roller 2 being charging means. Then, an electrostatic latent image of image information is formed on the charged surface by the scanning exposure of a laser beam 4 output from exposure means 3 in a modulated (on/off converted) state correspondingly to the pixel signals of the image information input into the exposure means 3 from a not shown image reading apparatus, an image signal generating apparatus such as a personal computer, or the like through a print interface. At this time, the laser beam 4 output from the exposure means 3 is deflected against the photosensitive drum 1 by a laser beam reflection mirror 5.

The electrostatic latent image formed on the photosensitive drum 1 in the way described above is developed with a developer conveyed to the electrostatic latent image portions by a fixed developing apparatus 6*b* being a second developing apparatus and a rotation developing apparatus 6*a* being a first developing apparatus. The fixed developing apparatus 6*b* adopts a one-component developing method and contains a black toner therein. The rotation developing apparatus 6*a* is provided on the downstream side of the fixed developing apparatus 6*b* in the moving direction (rotation direction) of the surface of the photoelectric drum 1. The rotation developing apparatus 6*a* adopts a two-component developing method and a switching method of a plurality of two-component developing devices 6Y, 6M and 6C containing toners having colors different from each other therein, respectively.

Developing means 6 as image forming means is composed of the fixed developing apparatus 6*b* and the rotation developing apparatus 6*a* mounting the plurality of the developing devices 6Y, 6M and 6C thereon.

The yellow developing device 6Y, the magenta developing device 6M and the cyan developing device 6C, each being a developing device containing a two-component developer therein, are supported by a rotary member (rotation support device) 6*c* in the states of being rotatable into the direction of an arrow B shown in FIG. 1, and constitute the rotation developing apparatus 6*a* adopting the rotation switching method of performing the development of each color toner by opposing the developing devices 6Y, 6M and 6C to the photosensitive drum 1 sequentially. The yellow developing device 6Y, the magenta developing device 6M and the cyan developing device 6C contain two-component developers including non-magnetic toners (each having a negative polarity) and magnetic carriers. The mixing ratios of the non-magnetic toners and the magnetic carriers are each about 1:9 in weight ratios.

Moreover, as shown in FIG. 2, the two-component developing devices 6Y, 6M and 6C include developing containers 62*y*, 62*m* and 62*c* containing respective color developers, respectively. Each of the developing containers 62*y*, 62*m* and 62*c* is provided with an opening portion formed at an circumferential surface portion of the rotary member 6*c*. Developing sleeves 61*y*, 61*m* and 61*c*, each being a developer bearing member, are formed from these opening portions, respectively.

The surfaces of the developing sleeves 61*y*, 61*m* and 61*c* are exposed from the opening portions, and the rotary member 6*c* moves the developing devices 6Y, 6M and 6C in order that the exposed portions may be opposed to the photosensitive drum 1 at the time of development. Rotations of the developing sleeves 61*y*, 61*m* and 61*c* at the time of development convey developers from the developing containers 62*y*, 62*m* and 62*c* to the exposed portions, and successively convey the developers to the electrostatic latent image portions formed on the opposed photosensitive drum 1.

The developing sleeves 61*y*, 61*m* and 61*c* are composed of non-magnetic cylinders and magnetic field generating means (not shown), which are disposed in the developing sleeves 61*y*, 61*m* and 61*c* in the state in which the lengthwise directions of the generating means are the same as those of the developing sleeves 61*y*, 61*m* and 61*c*. The magnetic field generating means are fixed to the rotations of the non-magnetic cylinders. Each of the magnetic field generating means includes a plurality of poles, and the developing sleeves 61*y*, 61*m* and 61*c* bear and convey the developers by the operation of the magnetic poles.

Incidentally, the surfaces of the developing sleeves 61*y*, 61*m* and 61*c*, being the developer bearing members, are finished so as to be able to bear and convey the developers by receiving surface treatment processing using, for example, a sand blasting method using amorphous particles or figurate particles as abrasive particles, a sand paper method using a piece of sand paper to rub the surface of the developing sleeves 61*y*, 61*m* and 61*c* in their axis directions for forming irregularities in the circumferential directions of the developing sleeves 61*y*, 61*m* and 61*c*, a chemical treatment method, a method for forming resin projections after the coating of the surfaces of the developing sleeves 61*y*, 61*m* and 61*c* with an elastic resin, and the like.

The rotation developing apparatus 6*a* as a rotary member is configured to be a detachably mountable developing cartridge to the main body of the image forming apparatus 7. When the toners in the respective color toner developing devices 6Y, 6M and 6C have been consumed, the exchange of the rotation developing apparatus 6*a* makes it possible to form an image again.

On the other hand, the fixed developing apparatus 6*b* includes a black developing device 6B containing a black toner to be consumed much. The fixed developing apparatus 6*b* is also configured to be a developing cartridge similarly to the rotation developing apparatus 6*a*. The fixed developing apparatus 6*b* is configured to be detachably mountable to the main body of the image forming apparatus 7. The black developing device 6B contains a magnetic toner (having a negative polarity).

When the fixed developing apparatus 6*b* is mounted in the main body of the image forming apparatus 7, as shown in FIG. 2, a developing sleeve 61 being a rotatable developer bearing member is held with a minute gap (within a range of from 50 $\mu$m to 500 $\mu$m in the present embodiment) to the photosensitive drum 1, and a developing region for supplying the toner borne by the developing sleeve 61 to the photosensitive drum 1 is formed. The developing sleeve 61 has a configuration similar to those of the developing sleeves 61*y*, 61*m* and 61*c* provided in the two-component developing devices 6Y, 6M and 6C. The surface of the developing sleeve 61 receives surface treatment processing by one of the methods described above.

Feeding means 63 for feeding the toner toward the developing sleeve 61 is provided in the developing container 62 of the black developing device 6B, and a feeding roller 64 for feeding the toner fed by the feeding means 63 to the developing sleeve 61 is housed in the developing container 62. For the stable feeding of the toner to the developing sleeve 61 and for the implementation of the uniform coating of the toner, foamed rubber materials such as polyurethane and silicone are preferably used as the materials of the feeding roller 64. Furthermore, it is preferable to abut the feeding roller 64 against the developing sleeve 61, and to rotate the feeding roller 64 at the opposite position of the developing sleeve 61 into the direction designated by an arrow C shown in FIG. 2, which direction is the counter direction of the rotation direction of the developing sleeve 61, with a difference between the peripheral speeds. Moreover, a regulation blade 65 as a regulating member for regulating the layer thickness of the toner borne by the developing sleeve 61 is provided above the developing sleeve 61, and a blow-off preventing sheet 66 for preventing the blow-off of the toner from the lower part of the developing container 62 to the outside is provided below the developing sleeve 61.

In the configuration of the developing means 6, the surface of the photosensitive drum 1 is charged by the charging roller 2 (to about −600 V in the present embodiment). Next, exposure scanning by the exposure means 3 controlled to be on or off according to the image data of a first color (e.g. yellow) is performed, and an electrostatic latent image of the first color is formed on the photosensitive drum 1 (to have electric potential of about −100 V in the present embodiment). The electrostatic latent image of the fist color is developed to be a visible image by the yellow developing device 6Y containing a yellow toner of the first color (having the negative polarity). The developed image is a developer image (toner image) made of a developer. The visualized first toner image is transferred to the surface of an intermediate transfer drum 8 at a nip portion between the photosensitive drum 1 and the intermediate transfer drum 8, which is pressed to the photosensitive drum 1 with a predetermined pressing force and is driven to rotate into the direction designated by an arrow D at the speed substantially same as the peripheral speed of the photosensitive drum 1 (100 mm/s in the present embodiment).

The transfer process is repeated with regard to the other toners (a magenta toner, a cyan toner and a black toner) similarly, and toner images formed with different color toners contained in the respective developing devices are sequentially transferred and superposed on the intermediate transfer drum 8 at respective transfer processes to synthesize and form a color toner image.

Incidentally, the following intermediate transfer drum is used as the intermediate transfer drum 8 in the present embodiment. That is, a surface layer having a release characteristic formed of an urethane resin in which carbon, fluoroplastic or the like is dispersed on the surface of a conductive elastic layer made of nitrile-butadiene rubber (NBR) or the like is formed on an aluminum cylinder, and the resistance value of the surface layer is made to be a value within a range of from about $10^5$ to $10^{10}$ Ω·cm and further the outer diameter thereof is made to be 153 mm.

At the time of the transfers of the toner images to the inter mediate body drum 8, a predetermined voltage (+100 V in the present embodiment) having the reverse polarity to the charge polarity (−) of the toners is applied to the intermediate transfer drum 8. The toners remaining on the photosensitive drum 1 without being transferred to the intermediate transfer drum 8 at the time of transfers are scratched off with a cleaning blade 9*a* being cleaning means pressed against the photosensitive drum 1, and are collected into a waste toner container 9*b*.

The cleaning means 9 is means for cleaning the surface of the photosensitive drum 1 after a transfer of a toner image to the intermediate transfer drum 8. The cleaning means 9 abuts the cleaning blade 9*a* against the surface of the photosensitive drum 1, and scratches off the toner remaining on the surface of the photosensitive drum 1 to collect the remaining toner into the waste toner container 9*b*.

The cleaning blade system using the cleaning blade 9*a* made of an elastic body such as a rubber as described above has been widely used conventionally. The reason of the use is that the blade system cleaning device is simple in structure and small in size, and also advantageous in cost. A polyurethane rubber, a kind of thermoplastic elastomer, is mainly used as the material of the cleaning blade 9*a* owing to its chemical resistance, its abrasion resistance, its moldability, its mechanical strength and the like.

A method for pressing the cleaning blade 9*a* against the running surface of the photosensitive drum 1 in the counter direction is the main current of the cleaning apparatus 9 including the cleaning blade 9*a*. The cleaning operation mechanism of the method is considered to be based on the so-called Stick-Slip movements. In the Stick-Slip movements, when the cleaning blade 9*a* is pressed against the surface of the photosensitive drum 1 with a force (5 to 40 gf/cm) necessary for removing the remaining toner on the surface of the photosensitive drum 1, at the abutting portion of the edge portion of the cleaning blade 9*a* against the photosensitive drum 1, first, the edge portion of the cleaning blade 9*a* adhering to the surface of the photosensitive drum 1 deforms into the advancing direction of the photosensitive drum 1 (shear deformation, compression deformation), and then the energy caused by the stress to be stored at the edge portion of the cleaning blade 9*a* acts as a restoring force (rebound resilience force) to restore the edge portion. Accordingly, it is necessary to rationalize the amplitudes and the number of vibrations of the Stick-Slip movements for achieving stable cleaning properties in the cleaning means 9 using the cleaning blade 9*a*. For rationalizing the amplitudes and the number of vibrations of the Stick-Slip movements, the frictional force at the abutting part of the edge portion of the cleaning blade 9*a* against the surface of the photosensitive drum 1, the shape of the cleaning blade 9*a*, the physical properties of the material of the cleaning blade 9*a* (Young's modulus, Poisson's ratio, modulus (stress-strain curve)), and the like are adjusted.

Moreover, in FIG. 1, the toner remaining on intermediate transfer drum 8 without being transferred to the recording material P is removed from the intermediate transfer drum 8 by a cleaner 10.

The recording material P as a material to be recorded is fed one by one from a feeding cassette 11 to the intermediate transfer drum 8 with a sheet feeding roller 12*a* and conveying rollers 12*b*, and a voltage (+1000 V in the present embodiment) having the reverse polarity to the polarities of the toners is applied to a transfer roller 13 on the back face of the recording material P. Thereby, the full color toner image on the side of the intermediate transfer drum 8 is transferred to be formed on the recording material P.

The recording material P on which the full color image has been transferred is separated from the intermediate transfer drum 8 to be introduced into fixing means 14, and the toner image on the recording material P is heated to be fixed in the fixing means 14. The recording material P is delivered to a delivery tray 15 after that.

That is, the image forming apparatus 7 of the present embodiment is one using a one-component developing method and a two-component developing method jointly by adopting the fixed developing apparatus 6*b* including the black developing device 6B using the one-component jumping developing method described with regard to the conventional techniques, together with the rotation developing apparatus 6*a* employing the two-component developing method and mounting the three color developing devices 6M, 6C and 6Y, wherein the magnetic one-component toner is used for the formation of a black image and the two-component developers are used for the formation of a color image.

Now, the developers used in the present embodiment will be described in detail.

Non-magnetic toner particles each having about 8 $\mu$m of a volume-averaged particle diameter were used as ones included in the two-component developers to be used for the color developing apparatus 6*a* for forming a color image. The toner particles were produced in accordance with a polymerizing method. With an object of the improvement of the flow property of the negative charged toners, silica having an averaged particle diameters of 20 nm and titanium oxide were used by being externally added.

Then, carriers the surfaces of which were covered with a covering resin were used for the electrophotographic carriers being the magnetic particles included in the two-component developers to be used for the developing apparatus 6*a* after the consideration of the lengthening of the lives of the carries and of the stabilization of the charge giving function to the toners because the carriers were used by being mixed with the toners to be the two-component developers.

The covering resin for covering the carrier surfaces are suitably selected among the resins having electrical insulating properties on the basis of relations with toner materials and carrier core materials. In the present embodiment, the covering resin of the carrier surfaces is required to contain at least one kind of monomer to be selected among at least acrylic acid (or its ester) monomers and methacrylic acid (or its ester) monomers for the improvement of the adhesive property of the covering resin with the surfaces of the carrier core materials. In particular, when polyester resin particles having high negatively charging properties are used as the toner materials, it is preferable that the covering resin is further made to be a copolymer with a styrene series monomer with the object of stabilizing charging. The weight ratio of the styrene series monomer in the copolymer is preferably within a range of from 5 to 70% by weight.

Both of a method in which a covering material such as a resin is dissolved or suspended in a solvent and adhered to carriers by being coated thereon, and a method in which the covering material is simply mixed as fine particles can be adopted as the method for covering the surfaces of the carriers with a resin.

As usable monomers for the covering resin of the core materials of the carriers, there are styrene series monomers such as a styrene monomer, a chlorostyrene monomer, an $\alpha$-methyl styrene monomer, and a styrene-chlorostyrene monomer, acrylic series monomers such as acrylic ester monomers (a methyl acrylate monomer, an ethyl acrylate monomer, a butyl acrylate monomer, an octyl acrylate monomer, a phenyl acrylate monomer and a 2-ethylhexyl acrylate monoer), and methacrylic acid ester monomers (a methacrylic acid methyl monomer, a methacrylic acid ethyl monomer, a methacrylic acid buthyl monomer and a methacrylic acid phenyl monomer).

Metals, their alloys, their oxides and ferrites such as surface-oxidized iron, surface un-oxidized iron, nickel, copper, zinc, cobalt, manganese, chromium and rare-earth elements can be used as the carrier core materials (magnetic particles) used as the two-component developers. Preferably, a ferrite selected among the metals of zinc, copper, nickel and cobalt can be used from the point of view of magnetic characteristics. The manufacturing methods of the carrier core materials have no specific limitations.

In the present embodiment, magnetic carriers configured as described above and having saturation magnetization quantities as at every 10 $Am^2/kg$ within a range of from 30 to 80 $Am^2/kg$ in a magnetic field of 795.8 kA/m were used. Respective toners were mixed with the carriers having the respective magnetization quantities at a weight ratio of 8% against developers to be the developers. Moreover, each of the carriers had a number-averaged particle diameter of 40 $\mu$m and a specific resistivity of $10^{13}$ $\Omega$cm.

On the other hand, the so-called magnetic one-component fine particle diameter ground toner containing carbon black, magnetite and the like, which were widely used conventionally, was used as the magnetic toner being the one-component magnetic developer contained in the black developing device 6B used for the fixed developing apparatus 6*b*. Each of the particle diameters of the toner was about 9 $\mu$m, and the electrified charge quantity of the toner was about −10 μC/g. The saturation magnetization quantity as of the toner was 39 $Am^2$/kg. When the intensity of magnetization of the magnetic carrier at an external magnetic field of 79.58 kA/m was designated by a mark σ1000, the intensity σ1000 was 31 $Am^2$/kg.

A printed sheet of recording paper P being a recording material on which an image has been formed by the aforesaid image forming apparatus is sometimes used as a print manuscript, as described with regard to the conventional technique.

Figure 3:
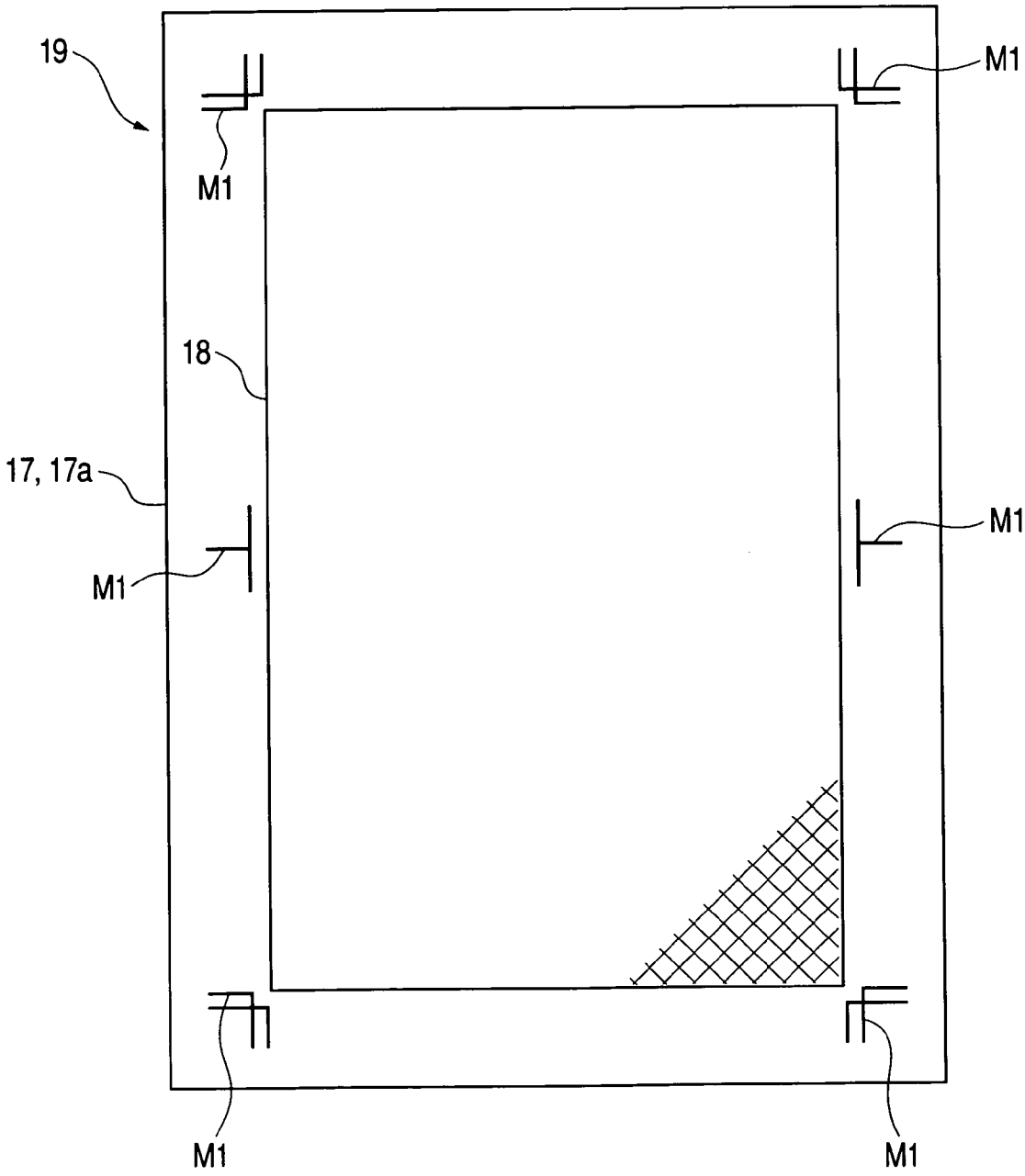
FIG. 3 is a front view showing an example of an art work.

Then, a process of producing the art work 19 by sticking the recording paper P printed with the image forming apparatus to the art work material 17 larger than the recording paper P in size is omitted. An art work material recording paper 17*a* having a size larger than the standard to be used as the art work material 17 is used, and the registration marks M1 are printed by the image forming apparatus 7 on the outside of the print region 18 together with the normal print formed in the print region 18 being the scope of the recording paper P to be used for normal image formation. Thus, the art work 19 shown in FIG. 3 is directly produced. That is, the image forming apparatus 7 uses the art work material recording paper 17*a* itself as the art work 19.

Moreover, in this case, as described pertaining to the conventional technique, the size of the sheet of art work recording paper 17*a* to be used for making the art work is larger than the standard size to the image to be formed, and accordingly the lengths of the developing sleeves should be designed to be longer for printing the registration marks M1. Consequently, there has been the problem that the image forming apparatus becomes large in size.

That is, the registration marks (dragonflies) M1 are generally widen into the top and the bottom by about 3 mm from the print region 18, which is the finish size. Moreover, because the registration marks M1 themselves need a length of about 10 mm severally, the sheet of art work material recording paper 17*a* to be the art work 19 should be able to be printed in a range widen than the print region (finish size) 18 by at least 13 mm on one side for printing the registration marks M1.

Incidentally, the registration marks M1 themselves are not required to be printed in full color because they are only required to be printed as references. That is, the registration marks M1 can be formed using one of the developing devices 6Y, 6M, 6C and 6B to be used.

Accordingly, the present embodiment set the length of the developing sleeve 61 in the black developing device 6B to be longer than those of the developing sleeves 61*y*, 61*m* and 61*c* for yellow, magenta and cyan to enlarge only the black printable region for printing the registered marks M1.

Thereby, the lengths of the developing sleeves 61*y*, 61*m* and 61*c* for yellow, magenta and cyan of the developing devices 6Y, 6M and 6C mounted on the rotation developing apparatus 6*a* could be shortened than that of the black developing sleeve 61 by 26 mm at the maximum. Consequently, the saving of the space around the rotation developing apparatus 6*a* could be achieved, and the size reduction of the main body of the image forming apparatus 7 could be achieved.

The reason why the developing sleeve 61 of the black developing device 6B is lengthened is that the rotation developing apparatus 6*a* can be left to be separated from the photosensitive drum 1 to increase an image formation efficiency when a monochrome image is formed, because the black developing device 6B is used but the other colors are not used at the time of the formation of the monochrome image. Moreover, it is also a reason that, because only the developing sleeve 61 of the developing device 6B mounted on the fixed developing apparatus 6*b* is lengthened, the shapes of the developing devices 6Y, 6M and 6C mounted on the rotation developing apparatus 6*a* formed separately from the fixed developing apparatus 6*b* can be formed to be the same in each shape. However, when the color of the developer contained in the fixed developing apparatus 6*b* is not black, the developing sleeves 61*y*, 61*m* and 61*c* of the developing devices 6Y, 6M and 6C of the other color may be lengthened according to the configuration of the image forming apparatus 7 and the working conditions of the apparatus 7.

Incidentally, because each of the developing sleeves 61*y*, 61*m*, 61*c* and 61 of the present embodiment is formed in a cylinder, the length of the lengthwise direction of a developing sleeve means the length of the cylindrical portion and the length of the cylinder was lengthened. However, in case of the other shapes, the surface treatment portions of the developer bearing surfaces of the developing sleeves can be lengthened. When a magnet roller being means for generating a magnetic field is contained, the length of the magnet roller can be lengthened.

Because the lengths of the lengthwise directions of the developing sleeves 61*y*, 61*m* and 61*c* for yellow, magenta and cyan are shortened in comparison with the length of the black developing sleeve 61 in the present embodiment, it is needless to say that the lengths of the magnet rollers and the lengths of the surface treatment portions of the developer bearing members are also shortened.

Consequently, because the image forming apparatus 7 of the present embodiment lengthens only the developing sleeve 61 of the black developing device 6B, it is unnecessary for the present embodiment to change the shapes of the other developing devices 6Y, 6M and 6C, and it is possible to prevent the enlargement of the size of the image forming apparatus 7.

Moreover, because, in the present embodiment, only the developing sleeve 61 of the black developing device 6B is made to be longer than those of the other developing sleeves 61*y*, 61*m* and 61*c* of the other developing devices 6Y, 6M and 6C, and because the lengths of the other developing sleeves 61*y*, 61*m* and 61*c* of the other developing devices 6Y, 6M and 6C are made to be the same, the configurations of the other developing devices 6Y, 6M and 6C can be made to be the same, and it becomes easy to mount the other developing devices 6Y, 6M and 6C on the rotation developing apparatus 6*a*. In addition, the size reduction of the rotation developing apparatus 6*a* can be achieved.

Incidentally, the lengthwise lengths of the chargeable areas, the cleanable areas and the transferable areas of charging devices, the cleaning means 9 and the intermediate transfer drum 8, all of which are disposed around the photoconductor, are lengths necessary for forming the registration marks (dragonflies) M1, respectively. The lengthwise lengths of the other components pertaining to the formation of images other than the above-mentioned components also are lengths necessary for forming the registration marks M1.

[Embodiment 2]

The present invention can be applied to the image forming apparatus having the configuration other than that of Embodiment 1 as long as the image forming apparatus include a plurality of developing devices.

Figure 4:
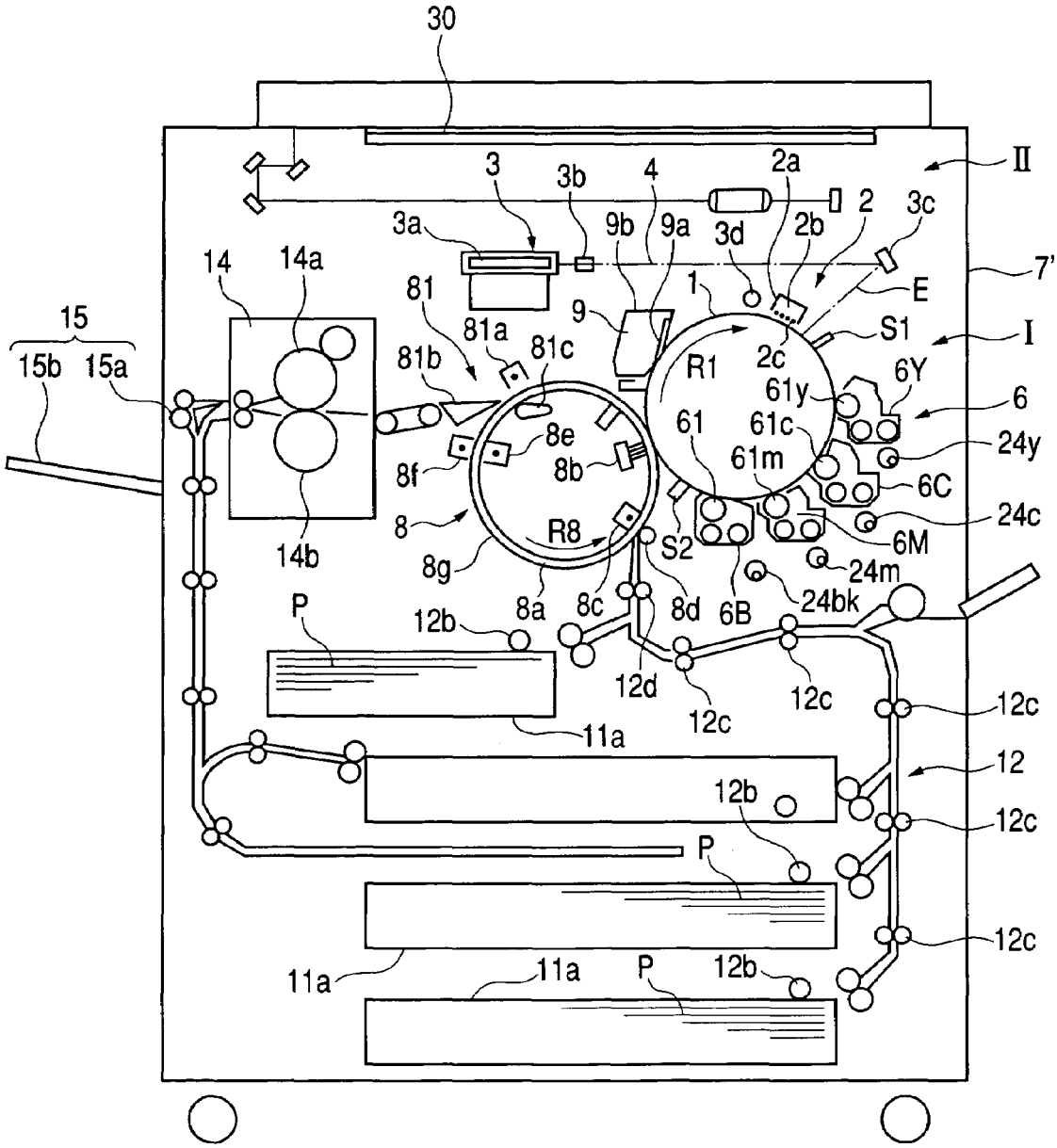
FIG. 4 is a schematic structural view showing another embodiment of an image forming apparatus according to the present invention.
Figure 5:
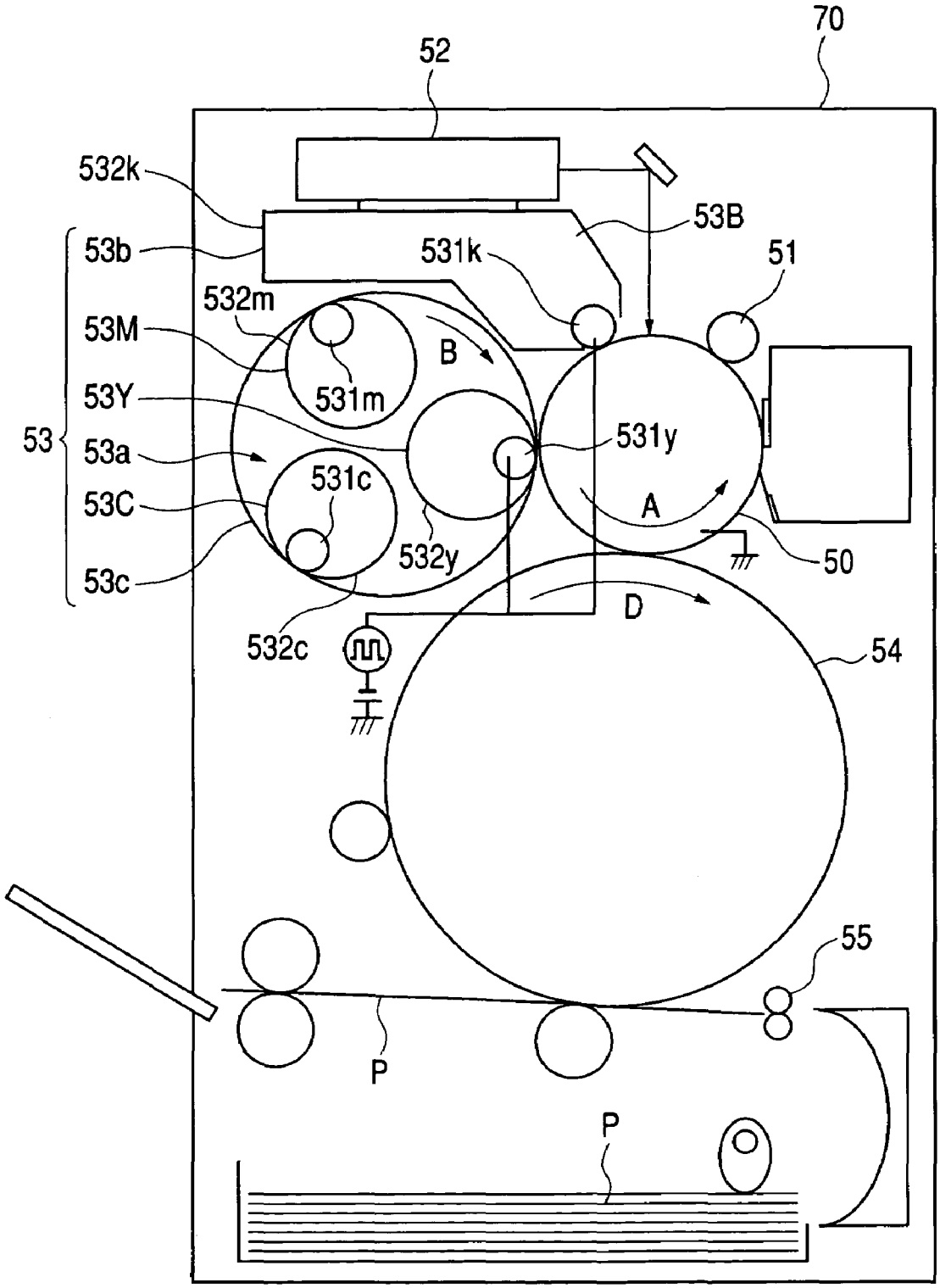
FIG. 5 is a schematic structural view showing an example of a conventional image forming apparatus.

A color image forming apparatus 7' of the present embodiment is one shown in FIG. 4. The color image forming apparatus 7' is provide with a digital color image printer portion (hereinafter referred to as "printer portion") I at the lower part, and a digital color image reader portion (hereinafter referred to as "reader portion") II at the upper part. The color image forming apparatus 7' forms an image on a recording material P with the printer portion I on the basis of the image of a manuscript 30 read with the reader portion II.

The printer portion I includes a photosensitive drum 1 as an image bearing member to be driven to rotate in the direction of an arrow R1. Around the photosensitive drum 1, a primary charger (charging means) 2, exposure means (latent image forming means) 3, developing means 6, a transfer device 8, a cleaning device 9, a pre-exposure lamp 3*d* and the like are disposed.

A sheet feeding and conveying portion 12 of the recording material P is disposed at the lower part of the transfer device 8, namely at the lower half part of the printer portion I, and separating means 81 is disposed at the upper part of the transfer device 8. Moreover, a fixing device 14 and a sheet delivery portion 15 are disposed on the downstream side of the separating means 81 (in the conveyance direction of the recording material P).

The photosensitive drum 1 includes a drum-shaped base made of aluminum and a photosensitive member of an organic photoconductor (OPC), and is driven to rotate at a predetermined process speed (peripheral speed) in the direction of the arrow R1 by a drive means (not shown).

The primary charger 2 is a corona charger including a shield 2*a* having an opened part opposed to the photosensitive drum 1, a discharge wire 2*b* disposed in the inside of the shield 2*a* in parallel to the bus line of the photosensitive drum 1, and a grid 2*c* disposed at the opened part of the shield 2*a* for regulating charging potential. Moreover, a charging bias is applied to the primary charger 2 by a power source (not shown), and thereby the primary charger 2 charges the surface of the photosensitive drum 1 to predetermined electric potential in a predetermined polarity uniquely. A suction duct (not shown) for introducing the air on the outside of the machine into the neighborhood of the primary charger 2 is provided above the primary charger 2, and the suction port of the suction duct is provided with a blast fan (not shown). The air sucked from the outside of the machine by the suction fan is introduced into the suction duct, and blows upon the surface of the photosensitive drum 1 from the upper part of the primary charger 2. By the blowing system, ozone, NOx and the like to be generated by discharges in the primary charger 2 are eliminated from the primary charger 2.

The exposure means 3 includes a laser output portion (not shown) for emitting a laser beam 4 on the basis of an image signal from the reader portion II, a polygon mirror 3*a* for reflecting the laser beam 4, a lens 3*b* and a mirror 3*c*. The laser beam 4 irradiates the surface of the photosensitive drum 1 to expose the photosensitive drum 1. Thereby, the charges in the exposed portions are eliminated from the surface, and an electrostatic latent image is formed. In the present embodiment, the electrostatic latent image formed on the surface of the photosensitive drum 1 is separated into four colors of yellow, cyan, magenta and black on the basis of the image of the manuscript, and toner images are formed by the respective color toners.

The transfer device 8 includes a transfer drum (recording material bearing member) 8*a* for bearing the recording material P on the surface of the transfer drum 8*a*, a transfer charger (transfer charging means) 8*b* for transferring the toner image on the photosensitive drum 1 to the recording material P, an attracting charger 8*c* for adsorbing the recording material P to the transfer drum 8*a*, an adsorption roller 8*d* opposed to the attracting charger 8*c*, an inside charger 8*e* and an outside charger 8*f*. A recording material bearing sheet 8*g* formed of a dielectric substance are cylindrically provided in a stretched state to be one body at an opened region on the peripheral surface of the transfer drum 8*a* supported by a shaft to be driven to rotate in the direction designated by an arrow R8. A dielectric sheet such as a polycarbonate film is used as the recording material bearing sheet 8*g*.

The cleaning device 9 is provided with a cleaning blade 9*a* for scratching off the residual toners remaining on the surface of the photosensitive drum 1 without being transferred to the recording material P, and a cleaning container 9*b* for collecting the scratched toners. The pre-exposure lamp 3*d* is disposed adjacently to the primary charger 2 on the upstream side of the primary charger 2 in the rotation direction R1 of the photosensitive drum 1, the pre-exposure lamp 3*d* removes unnecessary charges on the surface of the photosensitive drum 1, which has been cleaned by the cleaning device 9.

The sheet feeding and conveying portion 12 includes a plurality of sheet feeding cassettes 11*a* loading and containing recording materials P having different sizes, sheet feeding rollers 12*b* for feeding the recording materials P in the sheet feeding cassettes 11*a*, many conveyance rollers 12*c*, registration roller 12*d* and the like. The sheet feeding and conveying portion 12 feeds a sheet of recording material P having a predetermined size to the transfer drum 8*a*.

The stripping means 81 includes a stripping charger 81*a* for stripping off the recording material P after the transfer of the toner images from the transfer drum 8*a*, a stripping claw 81*b*, a stripping and pushing-up runner 81*c* and the like. The fixing device 14 includes a fixing roller 14*a* containing a heater in the inside thereof, and a pressure roller 14*b* disposed below the fixing roller 14*a* for thrusting the recording material P to the fixing roller 14*a*.

Moreover, a potential sensor S1 for detecting the charged potential of the surface of the photosensitive drum 1 is disposed between the primary charger 2 and the developing means 6 around the photosensitive drum 1. Moreover, a density sensor S2 for detecting the densities of toner images on the photosensitive drum 1 is disposed between the developing means 6 and the transfer drum 8*a*.

The image forming processes in the image forming apparatus 7' of the present embodiment configured as above will be described.

In the developing means 6, a yellow developing device 6Y is moved to a predetermined developing position by the operation of an eccentric cam 24*y*, and the other developing devices 6C, 6M and 6B escape from their developing positions by the operation of eccentric cams 24*c*, 24*m* and 24*bk*, respectively.

Moreover, the charging bias is applied to the primary charger 2 by the power source (not shown), and thereby the primary charger 2 charges the surface of the photosensitive drum 1 to the predetermined electric potential in the predetermined polarity uniquely.

After that, the exposure means 3 radiates a laser beam on the basis of the image signal from the reader portion II to form the electrostatic latent image on the photosensitive drum 1.

The developing device 6Y adheres a yellow toner to the electrostatic latent image on the photosensitive drum 1, and the electrostatic latent image is visualized to be a toner image. The yellow toner on the photosensitive drum 1 is adhered to be visualized to the toner image. The yellow toner image on the photosensitive drum 1 is transferred to the recording material P borne by the transfer drum 8*a*.

A recording material P having a size suitable to the manuscript image is fed from a predetermined sheet feeding cassette 11*a* to the transfer drum 8*a* at predetermined timing through the sheet feeding roller 12*b*, the conveying rollers 12*b*, the registration roller 12*d* and the like. The recording material P, which has been fed as described above, is adsorbed to the surface of the transfer drum 8*a* as a coil, and rotates in the direction designated by the arrow R8. Then, the yellow toner image on the photosensitive drum 1 is transferred to the recording material P by the transfer charger 8*b*.

On the other hand, the remaining toner on the surface of the photosensitive drum 1 after the transfer of the toner image is removed by the cleaning device 9, and unnecessary charges on the photosensitive drum 1 is removed by the pre-exposure lamp 3*d*. Then, the photosensitive drum 1 is supplied to the next image formation starting from the primary charging.

Each process of from the reading of the manuscript image by the reader portion II up to the cleaning and the static elimination of the photosensitive drum 1 through the transfer of the toner image to the recording material P on the transfer drum 8*a* is similarly performed with regard to each color other than yellow, namely with regard to cyan, magenta and black. Then, four color toner images are transferred to the recording material P on the transfer drum 8*a* in the way of being superposed on one another.

The recording material P, on which the four color toner images have been transferred, is stripped off from the transfer drum 8*a* by the stripping charger 81*a*, the stripping claw 81*b* and the stripping and pushing-up runner 81*c*, and is conveyed to the fixing device 14 in the state of bearing unfixed toner images on the surface of the recording material P. The toner images on the surface of the recording material P are heated and pressurized by the fixing roller 14*a* and the pressure roller 14*b* of the fixing device 14 to be fusion-bonded. That is the toner images are fixed. The recording material P after the fixation is delivered onto a delivery tray 15*b* with delivery rollers 15*a* in the sheet delivery portion 15.

The image forming apparatus of Embodiment 1 mounts the plurality of developing devices 6Y, 6M and 6C on the rotation developing apparatus 6*a*, and is provided with developing devices of the rotation developing apparatus 6*a* and the fixed developing apparatus 6*b* at two positions. On the other hand, as described above, the image forming apparatus according to the present embodiment is characterized in that the image forming apparatus is provided with the developing devices 6Y, 6M, 6C and 6B, as developing means, by the number of colors, which developing devices are severally disposed around the photosensitive drum 1 as separated bodies. In the image forming apparatus of the present embodiment also, the registration marks M1 are printed on the recording paper for a printing manuscript.

In such an image forming apparatus as is configured to have a plurality of developing devices 6Y, 6M, 6C and 6B disposed around the photosensitive drum 1, the setting of the length of the developing sleeve 61 in the black developing device 6B to be longer than those of the developing sleeves 61*y*, 61*m* and 61*c* for yellow, magenta and cyan, respectively, for the printing of the registration marks M1 to expand only the printable region of black saves the space around the color developing devices 6Y, 6M and 6C, and to enable the size reduction of the main body of the image forming apparatus 7', and further to enable the printing of the registration marks M1 without causing no problems with the black developing device 6B. Thus the advantages of the present invention could be confirmed.

Because the registration marks M1 themselves are sufficient to be formed as only marks, and because the color developing devices 6Y, 6M and 6C are formed to be separated from one another and it is easy to adopt different configurations of the respective developing devices 6Y, 6M and 6C in the present embodiment, any one of the lengths of the developing sleeves 61*y*, 61*m* and 61*c* of the developing devices 6Y, 6M and 6C of the other colors may be lengthened.

Incidentally, because the developing sleeves 61*y*, 61*m*, 61*c* and 61 are severally configured to be a cylinder also in the present embodiment, the lengthwise length of a developing sleeve means the length of the cylindrical portion, and therefore the cylindrical portion was lengthened. However, when the developing sleeves 61*y*, 61*m*, 61*c* and 61 are shaped in other shapes, the surface treatment portions of the developer bearing surfaces of the developing sleeves 61*y*, 61*m*, 61*c* and 61 can be lengthened. When magnet rollers being means for generating magnetic fields are contained, the lengths of the magnet rollers can be lengthened.

Incidentally, the lengthwise lengths of the chargeable areas, the cleanable areas and the transferable areas of charging devices, the cleaning device 9 and the transfer device 8 are lengths necessary for forming the registration marks (dragonflies) M1, respectively. The lengthwise lengths of the other components pertaining to the formation of images other than the above-mentioned components are also lengths necessary for forming the registration marks M1.

Consequently, because it is sufficient to lengthen only the developing sleeve 61 of the black developing device 6B in the image forming apparatus 7' of the present embodiment, it is unnecessary to change the shapes of the other developing devices 6Y, 6M and 6C, and then the increase of the size of the image forming apparatus 7' could be prevented.

Incidentally, the number of the developing devices and the kinds of colors are not limited to those used for Embodiments 1 and 2. The kinds of the developers are also not limited to those of Embodiments 1 and 2.

The image forming apparatus 7' configured as above makes it possible to provide an image forming apparatus capable of printing the registration marks and being reduced in size.

Incidentally, as described above, the registration marks for registration is not only used for the alignment at the time of sticking a recording material on which the registration marks have been formed to a medium having a size larger than that of the recording material, but also can be used at the time of forming a book, a magazine, an advertisement leaflet and the like.

For example, in case of a book, when a jacket (cover) or a book-band to be attached to (wound round) the main body of the book is produced, the registration marks are used as marks for folds of the jacket or the book-band or as marks for cutting the jacket or the book-band. Moreover, the registration marks are also used as marks for a region for coating an adhesive such as paste for sticking the backbone of a book to a bundle of sheets of paper.

As described above, the registration marks (dragonflies) are frequently formed around a desired color image formed on a recording material such as paper, namely in a region corresponding to a blank portion of the recording material conventionally.

Incidentally, a jacket (cover) is completed by putting a crease in a recording material on which registration marks have been formed together with a desired color image by the image forming apparatus of the present embodiment by the registration marks as marks, and by cutting the parts other than the parts where the color image has been formed so as to leave the part including the color image and capable of being the jacket (cover) as described above by the registration marks as marks. At the time of the completion of the jacket (cover), the registration marks have been cut off and are not present. Then, the attaching (winding) the completed cover to the main body of a book makes the book be completed. The processes of the jacket formation flow as above.

As described above, in the present embodiment, the maximum length in the lengthwise direction of the developing region of the developing device for forming the registration marks for registration together with a normal color image is made to be longer than the maximum lengths of the developing regions of the other developing devices in their lengthwise directions. Consequently, it is possible to provide an image forming apparatus capable of forming the registration marks to be used for the production of a book or the like while the size reduction of the image forming apparatus can be achieved.

What is claimed is:

1. An image forming apparatus comprising a plurality of image forming means for forming images having different colors from one another on a recording material, wherein a length of a lengthwise direction of a region, in which said images can be formed, of image forming means for forming a registration mark on said recording material is longer than a length of other imager forming means.

2. An image forming apparatus according to claim 1, wherein said image forming means for forming said registration mark forms an achromatic image, and said other image forming means forms a chromatic image.

3. An image forming apparatus according to claim 2, wherein said image forming means for forming said registration mark forms a black image.

4. An image forming apparatus according to any one of claims 1–3, wherein said image forming means for forming said registration mark includes a developing device disposed fixedly around an image bearing member, and said other image forming means includes a developing device held by a rotary member disposed rotatably around said image bearing member.

5. An image forming apparatus according to claim 4, wherein a length of a lengthwise direction of a developer bearing member of said developing device for forming said registration mark is longer than a length of other developing device.

6. An image forming apparatus according to claim 1, wherein said image forming means for forming said registration mark includes a developing device for performing development with one-component developer, and said other image forming means includes a developing device for performing development with two-component developer.

7. An image forming apparatus according to claim 6, wherein a length of a lengthwise direction of a developer bearing member of said developing device for forming said registration mark is longer than a length of the developing device of said other image forming means.

* * * * *

UNITED STATES PATENT AND TRADEMARK OFFICE

CERTIFICATE OF CORRECTION

PATENT NO. : 6,975,828 B2
DATED : December 13, 2005
INVENTOR(S) : Yuji Bessho et al.

It is certified that error appears in the above-identified patent and that said Letters Patent is hereby corrected as shown below:

Title page,
Item [56], References Cited, U.S. PATENT DOCUMENTS,
"6,650,864 11/2003 Kikuchi et al." should read
-- 6,650,864 11/2003 Miyamoto et al. --.

Column 2,
Line 20, "contact" should read -- in contact --;
Line 31, "method," should read -- methods, --; and
Line 38, "are" should read -- is --.

Column 3,
Line 52, "development" should read -- development of --.

Column 5,
Line 2, "imager" should read -- image --;
Line 34, "cross sectional" should read -- cross-sectional --; and
Line 62, "not shown" should read -- not-shown --.

Column 11,
Line 39, "widen" should read -- wider --.

Column 13,
Line 1, "provide" should read -- provided --.

UNITED STATES PATENT AND TRADEMARK OFFICE

CERTIFICATE OF CORRECTION

PATENT NO. : 6,975,828 B2
DATED : December 13, 2005
INVENTOR(S) : Yuji Bessho et al.

It is certified that error appears in the above-identified patent and that said Letters Patent is hereby corrected as shown below:

Column 15,
Line 67, “no” should read -- any --.

Column 17,
Line 25, “comprising” should read -- comprising: --; and
Line 32, “imager” should read -- image --.

Signed and Sealed this

Thirtieth Day of May, 2006

JON W. DUDAS
*Director of the United States Patent and Trademark Office*